US005655886A

United States Patent [19]

Alderson

[11] Patent Number: 5,655,886

[45] Date of Patent: Aug. 12, 1997

[54] VACUUM MAINTENANCE DEVICE FOR HIGH VACUUM CHAMBERS

[75] Inventor: Richard K. Alderson, Phoenix, Ariz.

[73] Assignee: Color Planar Displays, Inc., Fremont, Calif.

[21] Appl. No.: 469,512

[22] Filed: Jun. 6, 1995

[51] Int. Cl.[6] ..... I04B 37/02

[52] U.S. Cl. ..... 417/49; 313/7; 313/309

[58] Field of Search ..... 417/48, 49, 50; 445/24, 41; 313/7, 309, 346 R, 360.1, 495

[56] References Cited

U.S. PATENT DOCUMENTS

| | | | |
|---|---|---|---|
| 2,715,993 | 8/1955 | Batina | 230/69 |
| 2,726,805 | 12/1955 | Lawrence et al. | 230/69 |
| 2,727,167 | 12/1955 | Alpert | 313/7 |
| 2,967,012 | 1/1961 | Connor | 230/69 |
| 2,972,690 | 2/1961 | McCoubrey | 313/7 |
| 2,983,433 | 5/1961 | Lloyd et al. | 230/69 |
| 3,149,774 | 9/1964 | Jepsen | 230/69 |
| 3,172,597 | 3/1965 | Guyot | 230/69 |
| 3,216,652 | 11/1965 | Knauer | 230/69 |
| 3,228,589 | 1/1966 | Kearns | 230/69 |
| 3,382,388 | 5/1968 | Henderson et al. | 313/7 |
| 3,429,501 | 2/1969 | Hamilton et al. | 230/1 |
| 3,460,745 | 8/1969 | Lamont, Jr. | 230/69 |
| 3,489,336 | 1/1970 | Schonhuber | 230/69 |
| 3,540,812 | 11/1970 | Henderson et al. | 417/49 |
| 3,588,563 | 6/1971 | Schmidt | 313/7 |
| 3,591,827 | 7/1971 | Hall | 315/108 |
| 3,596,123 | 7/1971 | Levin | 313/7 |
| 3,631,280 | 12/1971 | Levin | 313/7 |
| 4,389,165 | 6/1983 | Ono et al. | 417/49 |

*Primary Examiner*—Timothy Thorpe
*Assistant Examiner*—Xuan M. Thai
*Attorney, Agent, or Firm*—Burns, Doane, Swecker & Mathis, LLP

[57] ABSTRACT

An ion pump permits the continuous evacuation of a small-envelope vacuum chamber while drawing a relatively small amount of power (micro watts). In a preferred embodiment, the present ion pump, due to its small size and integration within the vacuum chamber, enables the device in which the vacuum chamber is incorporated to be portable and to retain its original dimensions.

10 Claims, 3 Drawing Sheets

VACUUM MAINTENANCE DEVICE FOR HIGH VACUUM CHAMBERS

BACKGROUND OF THE INVENTION

1. Field of the Invention

The present invention relates to ion pumps, devices utilized to maintain vacuum within vacuum envelopes.

2. State of the Art

Problems are frequently encountered in glass-enclosed vacuum chambers in that gases are unavoidably introduced into the vacuum chamber through a number of sources. Such sources may include helium diffusion through the glass and typical "outgassing" of gases from materials located within the envelope due to electron stimulation, heat or the passage of time. These sources can introduce gases into the vacuum chamber and can lead to an increase in the chamber's pressure (a reduction of the vacuum).

Helium diffusion and the resulting pressure increase is especially a problem where the volume of the evacuated chamber is small compared to the surface area of the enclosing glass envelope. This situation occurs in planar vacuum chambers such as those of panel display devices. For example, an envelope formed by two 127 mm by 177.8 mm (5 inch by 7 inch) rectangular pieces of glass enclosing a chamber 1.5 mm thick would have a surface area of approximately 40,000 square mm. The corresponding volume of the chamber would be 34,000 cubic mm, a volume-to-area ratio of less than one.

In such a volume, unaided by any means for maintaining the chamber's vacuum, the partial pressure of Helium would rise within the evacuated chamber until it reached equilibrium with the level of Helium in the outside atmosphere. Helium naturally diffuses through glass, and under normal conditions, the diffusion would raise the level of helium within the chamber to the level of helium in atmosphere, resulting in an increase in pressure in the chamber to approximately 10 E-3 Torr. In an application where it is important to maintain a high vacuum, for example 10 E-6 Torr, some form of vacuum pumping becomes necessary.

Additionally, where an electrical field is present within the envelope, a dynamic environment will result which accelerates the continuous outgassing of materials located within the chamber. The outgassing is the result of the presence of electron bombardment within the chamber and is referred to as electron stimulated desorption. desorption of gases can also occur as a result of heat generated by various phenomena, and by the mere passage of time. Gas desorption will further reduce the vacuum unless some means is employed to continuously evacuate the envelope.

In the past, it has not been practicable to provide a continuous vacuum outside of a laboratory or a manufacturing environment. While passive gettering materials can be utilized within the vacuum chamber, they are not able to getter inert gases, such as helium, nor are they able to getter organic gases desorbed into the vacuum chamber. Various vacuum pumps are utilized in order to maintain vacuum against not only active materials, but also inert and organic materials. Previous vacuum pump technology consists of relatively large devices (for example, large turbo-pumps and cryo-pumps to the somewhat smaller cross-field ion pumps) which can be attached to an evacuated chamber via a port permitting access between the pump and the chamber. These pumps have been utilized in maintaining vacuum for various microwave and x-ray tubes in manufacturing and laboratory environments.

However, it has not been possible with previous vacuum pump technology to provide for continuous active maintenance of a small vacuum envelope while allowing for portability of the device incorporating the vacuum envelope, and retaining the device's original dimensions. The present invention addresses these needs.

SUMMARY OF THE INVENTION

The present invention permits the continuous evacuation of a small envelope vacuum chamber while drawing a relatively small amount of power (micro watts). In a preferred embodiment, the present ion pump, due to its small size and integration within the vacuum chamber, enables the device in which the vacuum chamber is incorporated to be portable and to retain its original dimensions.

Hence, in accordance with one aspect of the invention, the invention provides a means to continuously evacuate a vacuum envelope while drawing an extremely low level of power. The invention enables the continuous maintenance of a vacuum of at least 10 E-7 Torr while drawing micro watts of power. A standard AA lithium battery could, unassisted, provide sufficient power to maintain the vacuum for a period of ten years.

In accordance with another aspect of the invention, a means is provided to continuously evacuate a small volume vacuum chamber while maintaining the chamber's original dimensions and providing for the portability of the chamber, the means being integral to the chamber and very small in relative size.

In a preferred embodiment of the invention, the ability to maintain much lower pressure than heretofore possible enables the use of relatively higher voltage differentials than previously available within a field-emitter flat-panel display. The advantages of using such high voltage differentials within a field-emitter flat-panel display device are reduced power consumption and the ability to use high-voltage phosphors, which result in increased display life, improved chrominance, and increased brightness than with low-voltage phosphors. While the utilization of high-voltage phosphors offers these advantages over the use of low-voltage phosphors, the current state of the art has not permitted their use due to the possibility of gaseous breakdown or avalanching in the display's vacuum gap at high voltage differentials. By providing a means to substantially reduce the pressure of the vacuum, the probability of gaseous, microparticle and secondary-emission breakdowns is very significantly reduced.

The ion pump is comprised of an electron source (cathode), which electron source can be composed, by way of example only, of an array of field emitters, hot filament(s), or radio-active material, located at one end of a vacuum chamber. An anode is located opposite the cathode (across the vacuum chamber from the cathode). The area of the vacuum chamber composing the ion pump is separated from the main area of the vacuum chamber by means of an optically opaque shield. A surface layer of an appropriate active, or gettering, material is placed at the surface of the cathode interface with the vacuum chamber, with apertures as necessary for maintaining the flow of electrons from the cathode. Where a field emitter array is utilized as the electron source, for example, apertures permit the protrusion of field emitter tips. A gettering material may then be used as the gate metal of the field emitter array or may be deposited over the gate metal.

The cathode and anode are connected to a potential source. The electrons generated by the field emitter array are attracted to the positively charged anode. These electrons migrate across the vacuum to the anode. Generally, the electrons will flow to the anode where the electrical field is closed. However, a proportion of the electrons flowing to the anode will encounter free molecules within the vacuum which encounter has a certain probability of ionization (inelastic collision) resulting in the molecule becoming positively charged. The positively charged molecule, or ions, will be attracted to the negatively-charged cathode, while loose electrons resulting from the inelastic collision will be attracted to the positively-charged anode.

The ion will in most instances strike the surface of the gettering material as the ion travels to the cathode, and will cause sputtering of material from the gettering surface. The sputtered material will primarily be composed of neutrally charged molecules. The neutrally charged sputtered material will be ballistically propelled to other surfaces within the vacuum chamber area of the ion pump (for example, the sides and anode surface), and, upon colliding with such surfaces, will be deposited thereon. The sputtered material, being formed of active material, will chemically capture active gases.

The optically opaque shield serves to prevent migration of sputtered material into the primary vacuum chamber from the vacuum chamber of the ion pump.

If the ion strikes an inert gas on the surface of the cathode at a certain angle, the ion will dislodge inert neutrals. The inert neutrals will travel across the vacuum as a result of the impact with the ion and will implant within any surface they strike. Subsequently arriving sputtered material caused by ion impact on the cathode surface will be deposited over the implanted inert neutrals, further reducing their release and re-migration.

Organic materials (hydro-carbons) are broken down by electron bombardment into hydrogen and carbon molecules. This effect can also be caused by ion impacts upon organic materials present in the vacuum chamber. The resulting hydrogen molecule will be pumped by the active gettering process described above, while the carbon molecules or carbon compounds will precipitate (being a solid rather than a gas) to the active surfaces of the vacuum chamber as a result of gravity. They will then adhere to these surfaces as a result of Van der Waal forces.

In addition to utilizing the present invention as an advanced ion pump, it can also be used as a vacuum gauge. Two methods can be used in utilizing the invention as a vacuum gauge, a triode method and a diode method.

In the triode method, a fine etched sheet or wire mesh (the grid), with a majority of open area, is emplaced in the vacuum chamber of the ion pump between the cathode and the anode. The grid is connected to the potential source of the cathode. Most electrons flowing from the cathode to the anode will be able to get by the grid to reach the anode. However, any ions in the vacuum between the grid and the anode will tend to be attracted to the grid's negative charge and will impinge on the grid. Connecting the grid to an electrical meter will enable the measurement of the ion impacts (the ion current). The measurement of the ion current provides a measurement of the vacuum pressure.

In the diode method, a grid is not utilized. Instead, an active material is used as the gate metal of the field emitter array (the cathode of the ion pump). Ions created in the operation of the ion pump as described above will impact the gate metal as they are attracted to the cathode surface. This will create an ion current in the gate metal which can be measured by connecting an electrical meter to the gate metal. The appropriate dielectric, properly laid down, could be used in the structure of the field emitter array to prevent ion current leakage to the row metal (cathode or emitter electrode).

BRIEF DESCRIPTION OF THE DRAWING

The present invention may be further understood from the following description in conjunction with the appended drawing. In the drawing.

DETAILED DESCRIPTION OF THE PREFERRED EMBODIMENTS

Figure 1:
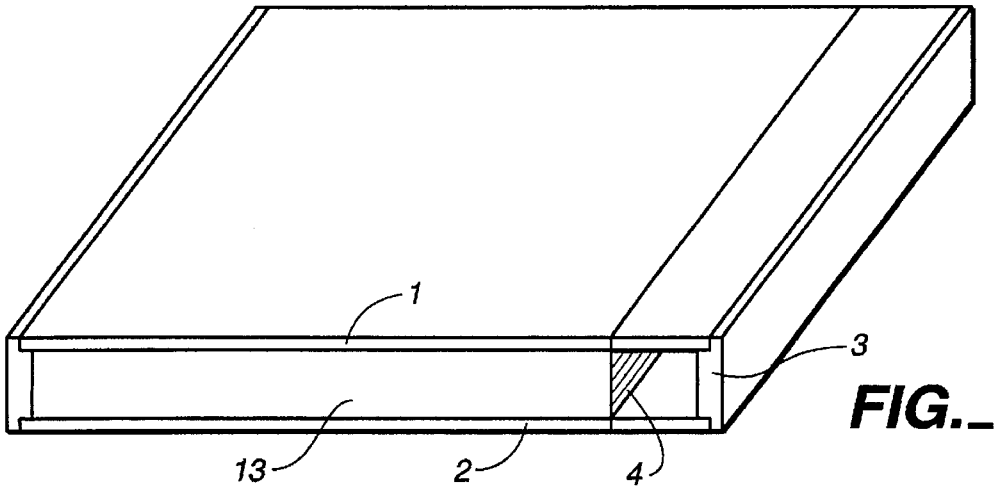
FIG. 1 is a perspective view of a planar vacuum chamber incorporating one embodiment of the ion pump of the present invention.

In a preferred embodiment, the present ion pump is adapted for placement within a planar vacuum chamber as found in flat-panel displays, especially flat-panel displays utilizing field-emitter cathodes. FIG. 1 illustrates the general placement of the ion pump along one edge of a planar vacuum chamber. The ion pump occupies the space enclosed by a first surface of the chamber 1, a second surface of the chamber 2, a side of the chamber 3, and an optically-opaque shield 4.

Figure 2:
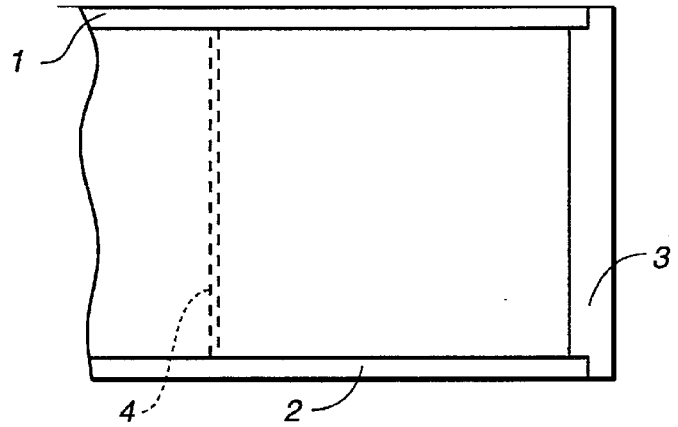
FIG. 2 is an end view of the ion pump of FIG. 1, utilizing a field emitter electron source.
Figure 3:
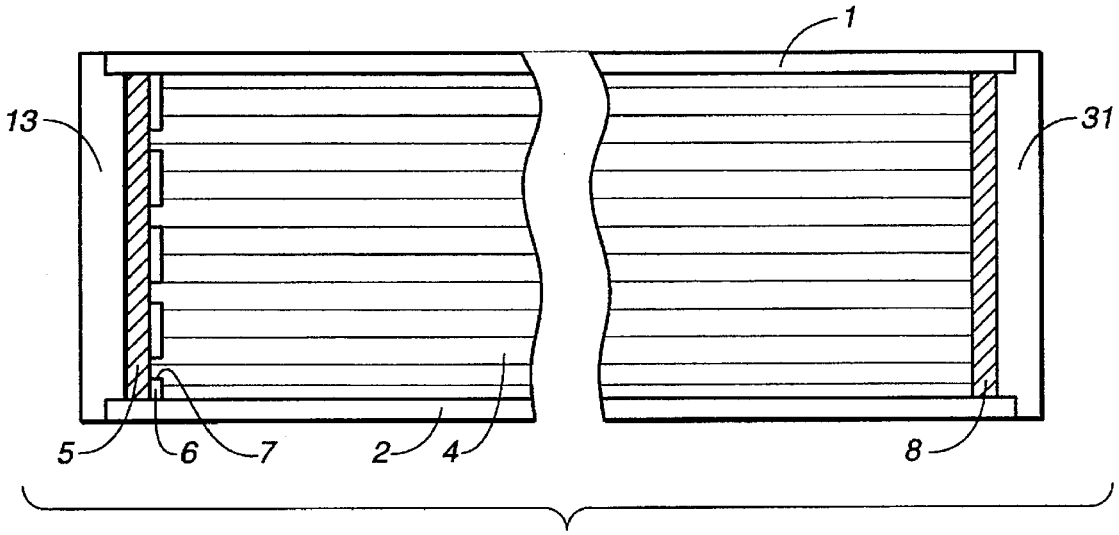
FIG. 3 is a side view of the ion pump of FIG. 1, utilizing a field emitter electron source.

FIG. 2 (end view) and FIG. 3 (side view) further illustrate the ion pump of FIG. 1 situated within a planar vacuum chamber. The ion pump of FIG. 1, FIG. 2, and FIG. 3 is referred to herein as a parallel planar ion pump, because the flow of electrons from the cathode is parallel to the first and second surfaces of the planar vacuum chamber. The ion pump occupies a portion of the display device's vacuum chamber, but is separated from the primary vacuum chamber by an optically opaque shield 4 which prevents migration of ions or sputtered material into the primary chamber from the ion pump chamber, but which permits relatively free flow of gases between the chambers. A cathode 5 is situated at one end of the ion pump chamber, adjacent a side 13 as shown in FIG. 3, and is covered by a layer 6 of appropriate gettering material. This layer of gettering material may contain one or more apertures 7 to permit the flow of electrons from the cathode 5 into the ion pump's vacuum chamber and toward the anode 8 located at an opposite end of the ion pump, adjacent a side 31. The longest dimension of the ion pump chamber (perpendicular to the side 13 in FIG. 1) is measured along what may be described as the "major axis" of the ion pump chamber. Similarly, the shortest dimension of the ion pump chamber (perpendicular to the side 3 and the optically-opaque shield 4 in FIG. 1) is measured along what may be described as the "minor axis" of the ion pump chamber.

In another preferred embodiment, the cathode 5 is composed of field emitters, although other electron sources, such as a hot filament or a radioactive source, can also be utilized to generate the electron flow. The apertures 7 are necessary where field emitters are used as an electron source. Where a hot-filament is utilized as the electron source, the filament may be suspended in the vacuum above the gettering material layer 6, and apertures are not necessary. Where a radioactive source of electrons is used, the radioactive material may be deposited as a thin film along with the gettering material onto the second surface 2 of the display, and no apertures are necessary. The flow of electrons from the cathode 5 is parallel to the display's view screen 1 and backing plate 2.

Figure 4:
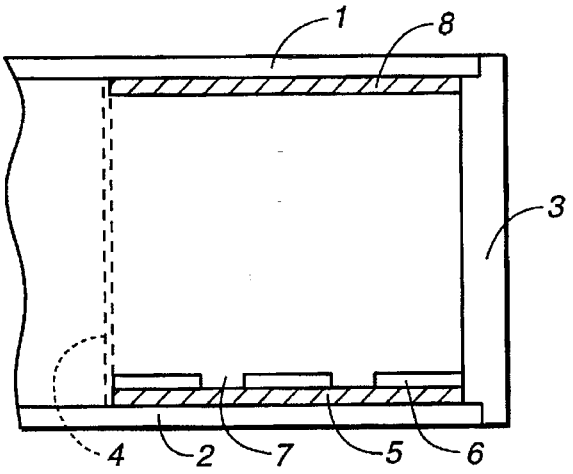
FIG. 4 is an end view of another embodiment of the ion pump of the present invention, utilizing a field emitter electron source.
Figure 5:
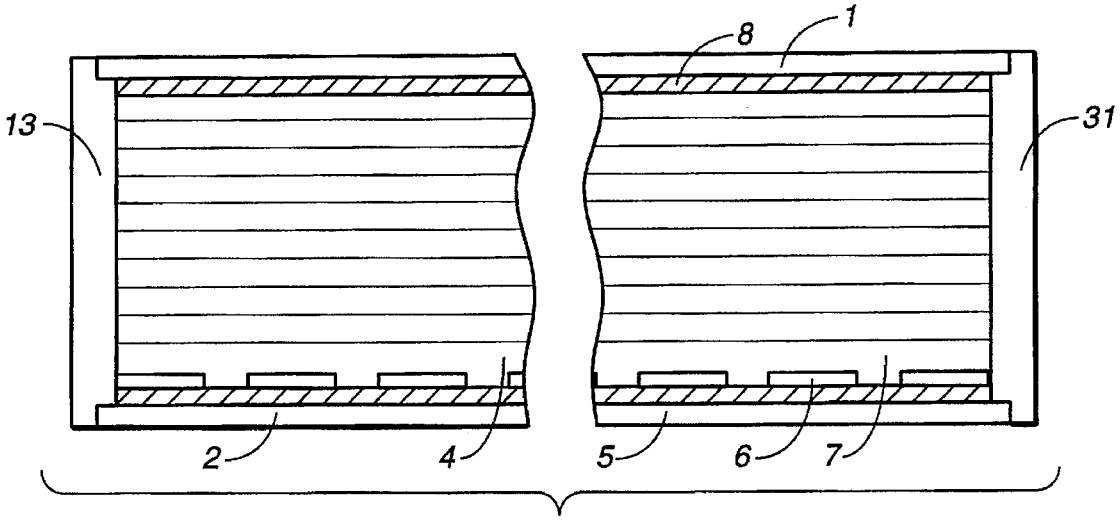
FIG. 5 is a side view of the ion pump of FIG. 4, utilizing a field emitter electron source.

Referring to FIG. 4 (end view) and FIG. 5 (side view), in another embodiment of the present ion pump, also situated within a planar vacuum chamber, the flow of electrons from the cathode is perpendicular to the first and second surfaces of the planar vacuum chamber. This embodiment of the ion pump is referred to herein as the perpendicular planar ion pump. As with the parallel planar ion pump, the perpendicular ion pump occupies the long space along one edge of the planar vacuum chamber (refer to FIG. 1). Also as in the parallel ion pump, the ion pump chamber is segregated from the primary vacuum chamber by an optically opaque shield 4, as shown in FIG. 4 and FIG. 5. The cathode 5 in this embodiment is situated along the second surface 2 of the planar chamber (backing plate of the flat panel display), rather than at the end of the planar chamber as in the parallel ion pump. The anode 8 is situated opposite the cathode on the first surface 1 of the planar chamber (view screen of the flat panel display), and across the vacuum of the ion pump chamber from the cathode 5. The cathode 5 is covered by a layer of appropriate gettering material 6, which layer may contain appropriate apertures 7 to permit the flow of electrons from the cathode 5 to the anode 8. The electron flow in this embodiment is perpendicular to the plane of the first surface 1 and second surface 2 of the planar chamber.

Figure 6:
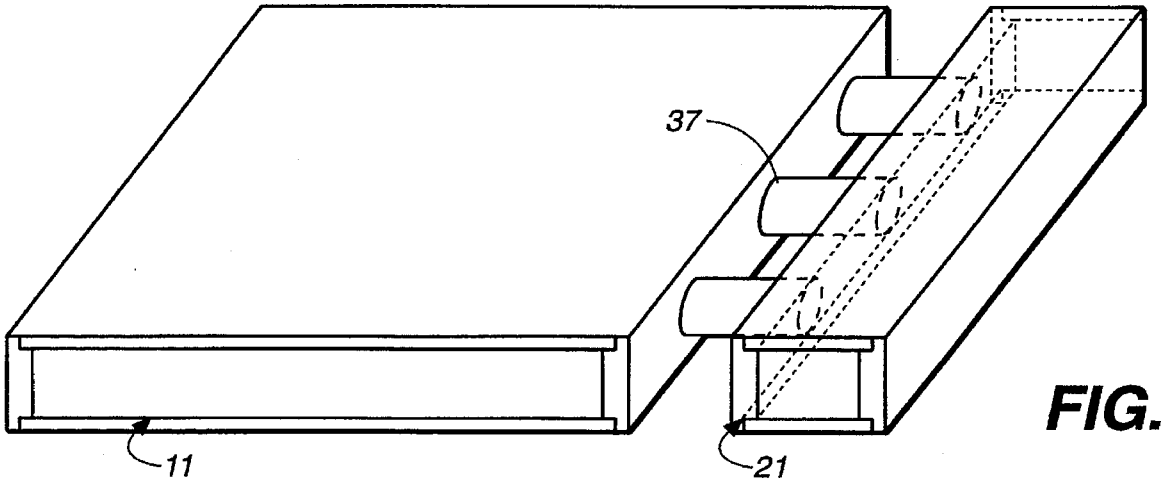
FIG. 6 is a perspective view of a planar vacuum chamber incorporating another, external, embodiment of the ion pump of the present invention.
Figure 7:
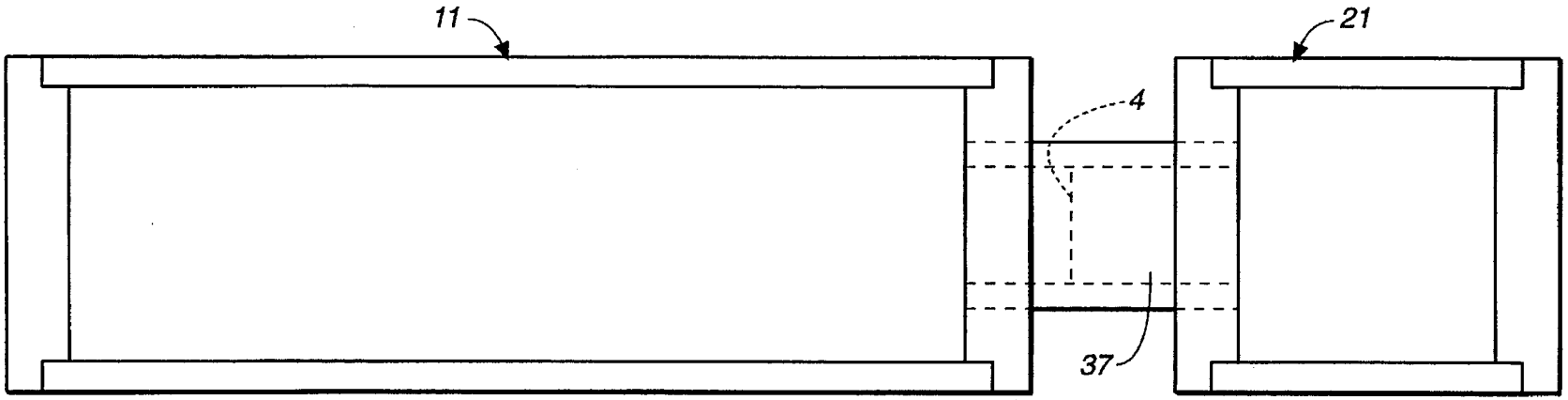
FIG. 7 is a sectional view of the ion pump of FIG. 6.

The ion pump need not be integral with a planar vacuum chamber to be pumped but may be externally mounted to the display as shown in the embodiment of FIG. 6 and FIG. 7. Referring first to FIG. 6, a planar vacuum chamber 11, such as a flat panel display, is connected to an electron emission ion pump 21 of the type previously described via ports 37. The ports 37 permit the flow of gases from the planar vacuum chamber 11 to the vacuum chamber of the ion pump 21. As shown in FIG. 7, an optically-opaque shield 4 of the type previously described is located within each of the ports 37. The optically-opaque shield 4 prevents the backflow of ions from the ion pump 21 into the planar vacuum chamber 11.

Figure 8:
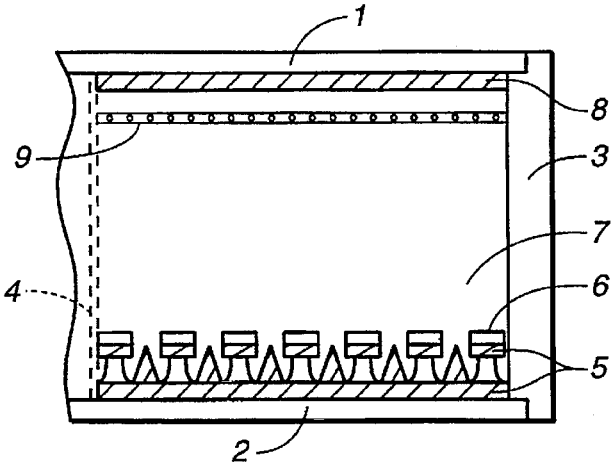
FIG. 8 is a sectional view of another embodiment of the invention in which an ion pump is used as a vacuum gauge.

Referring to FIG. 8, in another embodiment, the ion pump of the invention is used as a vacuum gauge. The ion pump may be either the parallel ion pump or the perpendicular ion pump. In the case of the perpendicular ion pump, the anode 8 of the ion pump is placed on the first surface 1 of the planar chamber as described above (in the parallel ion pump, the anode 8 would be placed on one side surface of the planar chamber). The cathode 5 is placed on the second surface 2 of the planar chamber as described above (in the parallel ion pump, the cathode 5 would be placed on a side surface of the planar chamber opposite the anode 8). A grid 9, which can be composed of a very fine wire mesh or a fine etched sheet, made of an active material, is emplaced in the vacuum between the anode 8 and cathode 5 of the ion pump. The grid 9 is connected to one terminal of a potential source, with the cathode 5 connected to the other terminal. The voltage applied to the grid 9 is set at a level slightly higher than that applied to the anode 8. Electrons generated by the cathode 5 will be attracted to the anode 8 and will encounter and impact the grid 9; however, ions in the vacuum between the grid 9 and the anode 8 will be attracted to and impinge upon the anode 8. The impact of the ions on the anode 8 will cause the active material of the anode to sputter. By connecting a meter to the anode, the ion current created by the impact of ions on the anode can be measured, which measure can be translated into the effective pressure of the vacuum chamber.

In an alternate embodiment of the vacuum gauge, the grid 9 is not utilized. The ions in the vacuum will be attracted to the active (gettering) material layer 6 placed on the cathode 5 surface. By attaching an electrical meter to the active layer 6, the ion current can be measured and translated to the effective pressure within the vacuum chamber.

Although described in connection with flat-panel displays, the present ion pump may be used wherever it is necessary to maintain a vacuum within a vacuum chamber. For example, the ion pump can be used to provide continuous evacuation of a double pane window structure, providing greater insulation than double pane windows with a gas in the planar volume between the panes.

It will therefore be appreciated by those of ordinary skill in the art that the invention can be embodied in other specific forms without departing from the spirit or essential character thereof. The presently disclosed embodiments are therefore considered in all respects to be illustrative and not restrictive. The scope of the invention is indicated by the appended claims rather than the foregoing description, and all changes which come within the meaning and range of equivalents thereof are intended to be embraced therein.

What is claimed is:

1. A device for the maintenance of high vacuum within a primary vacuum chamber, comprising:

an ion pump vacuum chamber, separated from the primary vacuum chamber by a gas-permeable, optically-opaque shield;

an electron source situated on one side of said ion pump vacuum chamber, and connected to one terminal of a potential source;

an anode situated within said ion pump vacuum chamber in a position across said ion pump vacuum chamber from said electron source, and connected to an opposite terminal of said potential source; and a layer of active material supported by a wall of said ion pump vacuum chamber and situated in close proximity to said electron source.

2. The apparatus of claim 1, wherein said electron source is a cathode, and said layer of active material is situated upon a surface of said cathode.

3. The apparatus of claim 2, further comprising apertures within said layer of active material for allowing the free flow of electrons from said cathode.

4. The apparatus of claim 1, further comprising:

a grid situated within the ion pump vacuum chamber between said anode and said electron source and connected to a potential source; and an electrical meter connected to said grid for measuring ion current created by ions impacting said grid.

5. The apparatus of claim 4, wherein said grid is formed of an active material.

6. The apparatus of claim 1, further comprising an electrical meter connected to said layer of active material for measuring ion current created by ions impacting said active material layer.

7. The apparatus of claim 1, wherein said primary vacuum chamber, and said ion pump vacuum chamber are integrally formed.

8. The apparatus of claim 1, wherein said primary vacuum chamber, and said ion pump vacuum chamber are separately formed and are joined by a port that allows gases to flow between said primary vacuum chamber, and said ion pump vacuum chamber.

9. A device for the maintenance of high vacuum within a primary vacuum chamber, comprising:

an ion pump vacuum chamber, separated from the primary vacuum chamber by a gas-permeable, optically-opaque shield;

an electron source situated on one side of said ion pump vacuum chamber, and connected to one terminal of a potential source;

an anode situated within said ion pump vacuum chamber in a position across said ion pump vacuum chamber from said electron source, and connected to an opposite terminal of said potential source; and a layer of active material supported by a wall of said ion pump vacuum chamber and situated in close proximity to said electron source;

wherein the primary vacuum chamber is a planar vacuum chamber having a major axis and a minor axis and first and second side surfaces parallel to said minor axis, and wherein said ion pump vacuum chamber is situated within and along one edge of said planar vacuum chamber, with said anode being placed on said first side surface, and said electron source being placed on said second side surface opposite said anode, permitting electrons to flow from said electron source to said anode in a plane perpendicular to said first and second side surfaces.

10. A device for the maintenance of high vacuum within a primary vacuum chamber, comprising:

an ion pump vacuum chamber, separated from the primary vacuum chamber by a gas-permeable, optically-opaque shield;

an electron source situated on one side of said ion pump vacuum chamber, and connected to one terminal of a potential source;

an anode situated within said ion pump vacuum chamber in a position across said ion pump vacuum chamber from said electron source, and connected to an opposite terminal of said potential source; and a layer of active material supported by a wall of said ion pump vacuum chamber and situated in close proximity to said electron source;

wherein the primary vacuum chamber is a planar vacuum chamber having a major axis and a minor axis and first and second planar surfaces parallel to said major axis, and wherein said ion pump vacuum chamber is situated within and along one edge of said planar vacuum chamber, with said anode being placed on said first planar surface, and said electron source being placed on said second planar surface opposite said anode, permitting electrons to flow from said electron source to said anode in a plane perpendicular to said first and second planar surfaces.

* * * * *